US010631689B2

(12) United States Patent
Trevizo

(10) Patent No.: US 10,631,689 B2
(45) Date of Patent: Apr. 28, 2020

(54) MOBILE HANDWASHING SYSTEM

(71) Applicant: Gabriel Joseph Trevizo, Gilbert, AZ (US)

(72) Inventor: Gabriel Joseph Trevizo, Gilbert, AZ (US)

( * ) Notice: Subject to any disclaimer, the term of this patent is extended or adjusted under 35 U.S.C. 154(b) by 0 days.

(21) Appl. No.: 16/398,136

(22) Filed: Apr. 29, 2019

(65) Prior Publication Data

US 2019/0343342 A1 Nov. 14, 2019

Related U.S. Application Data

(60) Provisional application No. 62/762,553, filed on May 8, 2018, provisional application No. 62/765,424, filed on Aug. 24, 2018.

(51) Int. Cl.
*A47K 1/02* (2006.01)

(52) U.S. Cl.
CPC ..... *A47K 1/02* (2013.01)

(58) Field of Classification Search
CPC ..... A47K 1/02
USPC ..... 222/190, 129, 132, 175; 220/523–525, 220/254.1, 254.2, 254.3, 703; 215/387
See application file for complete search history.

(56) References Cited

U.S. PATENT DOCUMENTS 4,932,563 A * 6/1990 Diamond ..... A45F 3/16 222/129
5,911,520 A * 6/1999 Kenney ..... A47K 3/288 4/603
6,010,034 A * 1/2000 Walthers ..... A47G 19/2266 222/129
8,281,957 B2 * 10/2012 Farmer ..... A47K 5/14 219/214
8,905,252 B2 * 12/2014 Latham ..... B65D 51/18 215/228
2010/0122993 A1 * 5/2010 Tenbrink ..... A61L 2/22 222/175
2011/0036867 A1 * 2/2011 Flores ..... A47K 5/1202 222/144.5
2013/0001243 A1 * 1/2013 Quick ..... A47K 3/285 222/135

* cited by examiner

*Primary Examiner* — Lien M Ngo
(74) *Attorney, Agent, or Firm* — Sandy Lipkin

(57) ABSTRACT

A mobile handwashing system includes a soap dispenser and a lid structured to fit both the soap dispenser and a water bottle. In a first embodiment, the water bottle is a rigid water bottle that screws onto the lid. The soap dispenser includes external threading on the reservoir that also screws onto the lid. In a second embodiment, the mobile hand washing system attaches to a plastic disposable water bottle and also includes a soap dispenser. In either embodiment, the system can be used to drink water and also separately to provide soap and water for hand washing or the like.

5 Claims, 7 Drawing Sheets

MOBILE HANDWASHING SYSTEM

CROSS-REFERENCE TO RELATED APPLICATIONS

This application claims the benefit of U.S. Provisional Application Nos. 62/762,553, filed on May 8, 2018; and 62/765,424, filed on Aug. 24, 2018; the subject matter of which is incorporated herein by reference.

TECHNICAL FIELD

The present disclosure relates generally to devices to assist in personal hygiene, and more particularly, to a mobile handwashing system.

BACKGROUND

Active individuals or active families when in public areas such as a zoo or a park often have limited resources and opportunities to wash their hands correctly with soap and water as needed. If soap and water are not readily available, hand washing may be avoided or delayed Although hand sanitizer, wipes or water alone may be used as a substitute if available, public health authorities such as the CDC advise using soap and water to wash one's hands as the best way to reduce the number of harmful microbes in most cases. Sanitizer is considered a "supplement" to hand washing by the CDC, and is not always effective for killing certain types of microbes. Moreover, these alternative methods for hand washing are less effective than soap and water when one's hands are dirty and greasy which can happen particularly with kids and in outdoor settings.

SUMMARY

A mobile handwashing system includes a soap dispenser and a lid structured to fit both the soap dispenser and a water bottle. In a first embodiment, the water bottle is a rigid water bottle that screws onto the lid. The soap dispenser includes external threading on the reservoir that also screws onto the lid. In a second embodiment, the mobile hand washing system attaches to a plastic disposable water bottle and also includes a soap dispenser. In either embodiment, the system can be used to drink water and also separately to provide soap and water for hand washing or the like.

DETAILED DESCRIPTION OF EXAMPLE EMBODIMENTS

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like elements but not necessarily the same or identical elements throughout.

Figure 1:
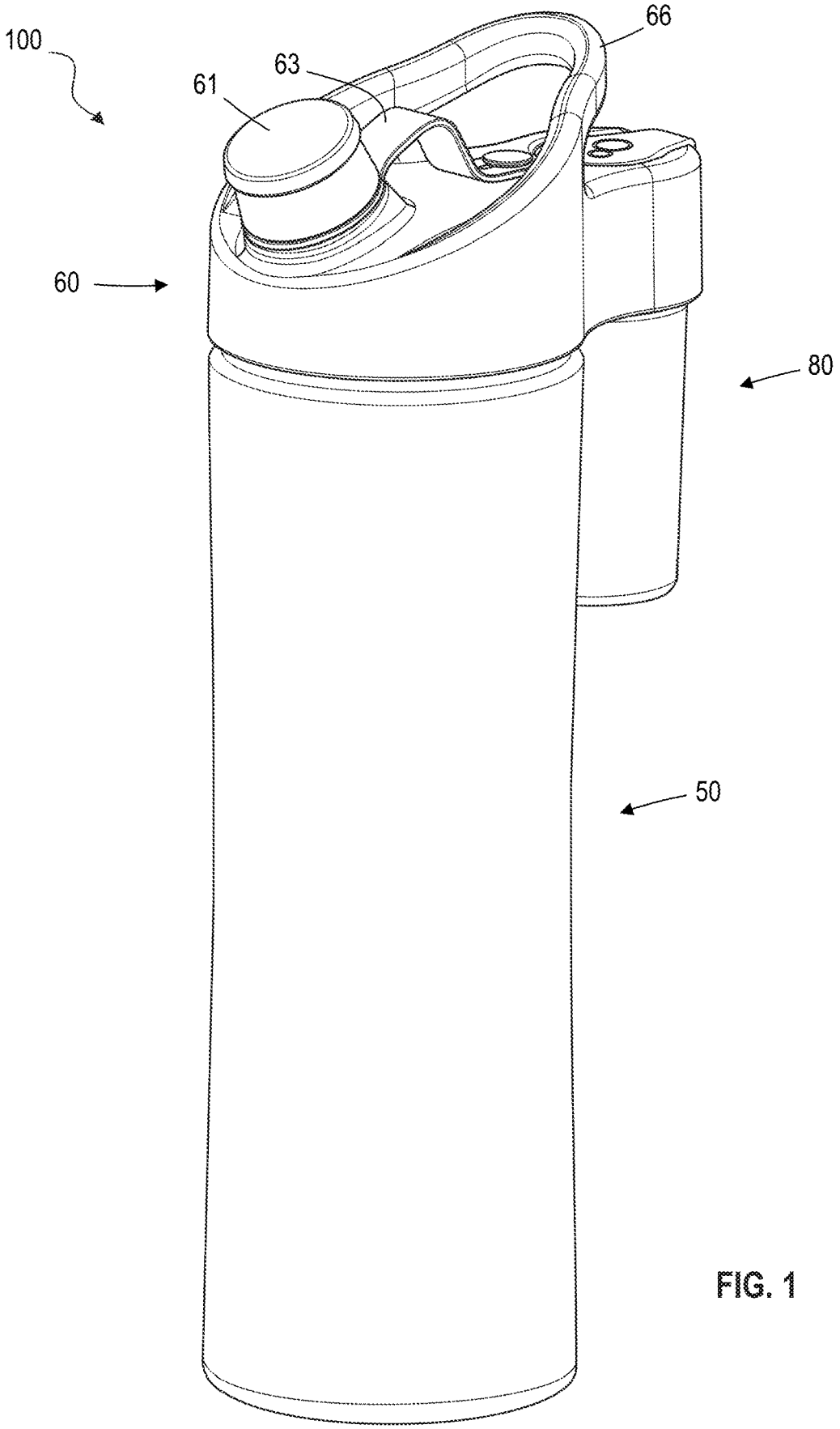
FIG. 1 shows a perspective view of a mobile handwashing system, according to a first embodiment of the disclosure.

Referring to FIG. 1, a perspective view of a mobile handwashing system 100, according a first embodiment of the disclosure, is illustrated. The mobile handwashing system 100 includes a water bottle 50, a soap dispenser 80, and a lid 60. The water bottle 50 is preferably made of a rigid material such as metal (e.g., stainless steel) or hard plastic, and preferably capable of holding at least 16 ounces of water though other volume capacities may suffice. The lid 60 can be made of a molded hard plastic, metal, or another suitable durable material. The lid 60 includes a cap 61 covering a rinse spout 62 (FIG. 3) where water can be poured to rinse one's hands after lathering. The water poured from the rinse spout 62 passes through a conduit 65 and exits. The user can also pour water for drinking by unscrewing the rinse spout 62 from the lid exposing a drinking spout 64. Because the drinking spout 64 has a larger diameter than the rinse spout 62, water pours at a faster rate from the drinking spout 64. Furthermore, since the drinking spout 64 and the rinsing spout 62 are separated, the user does not have to worry about contamination from the hand washing process. Also shown are a handle 66 for easy carrying and a tether 63 to connect the cap 61 to the lid 60. An important aspect of the disclosure is that the lid 60 is structured to be able to fit both the water bottle 50 and the soap dispenser 80. This arrangement allows the user to drink water when thirsty and also separately to provide soap and water for hand washing or the like.

Figure 2A:
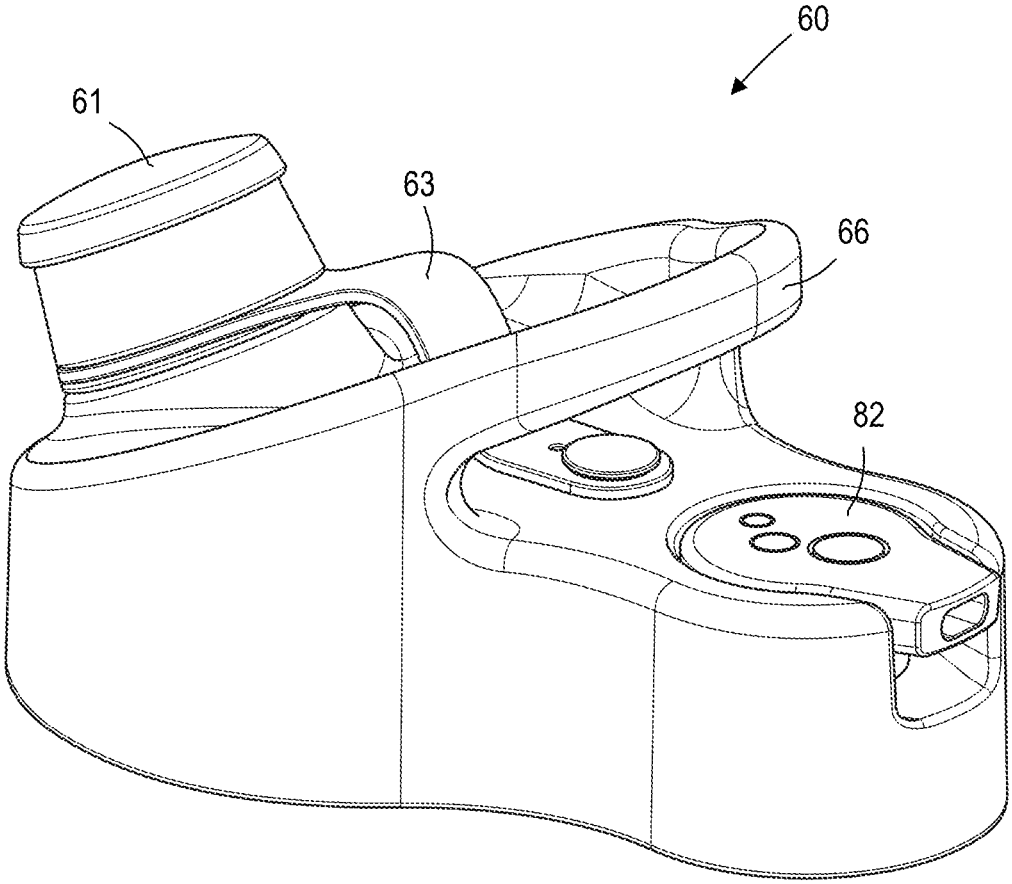
FIG. 2A shows a bottom perspective view of a lid usable in conjunction with the mobile handwashing system, according to the first embodiment of the disclosure.

FIG. 2A shows a top perspective view of the lid 60. From this view, the pump head 82 and the attachment of the tether 63 to the lid 60 are more clearly seen. It is to be understood, however, that the inclusion of the tether 63 and the cap 63 are not required; furthermore, it is to be understood that the particular ornamental aspects of the design illustrated in each of the drawings are not meant to be limiting.

Figure 2B:
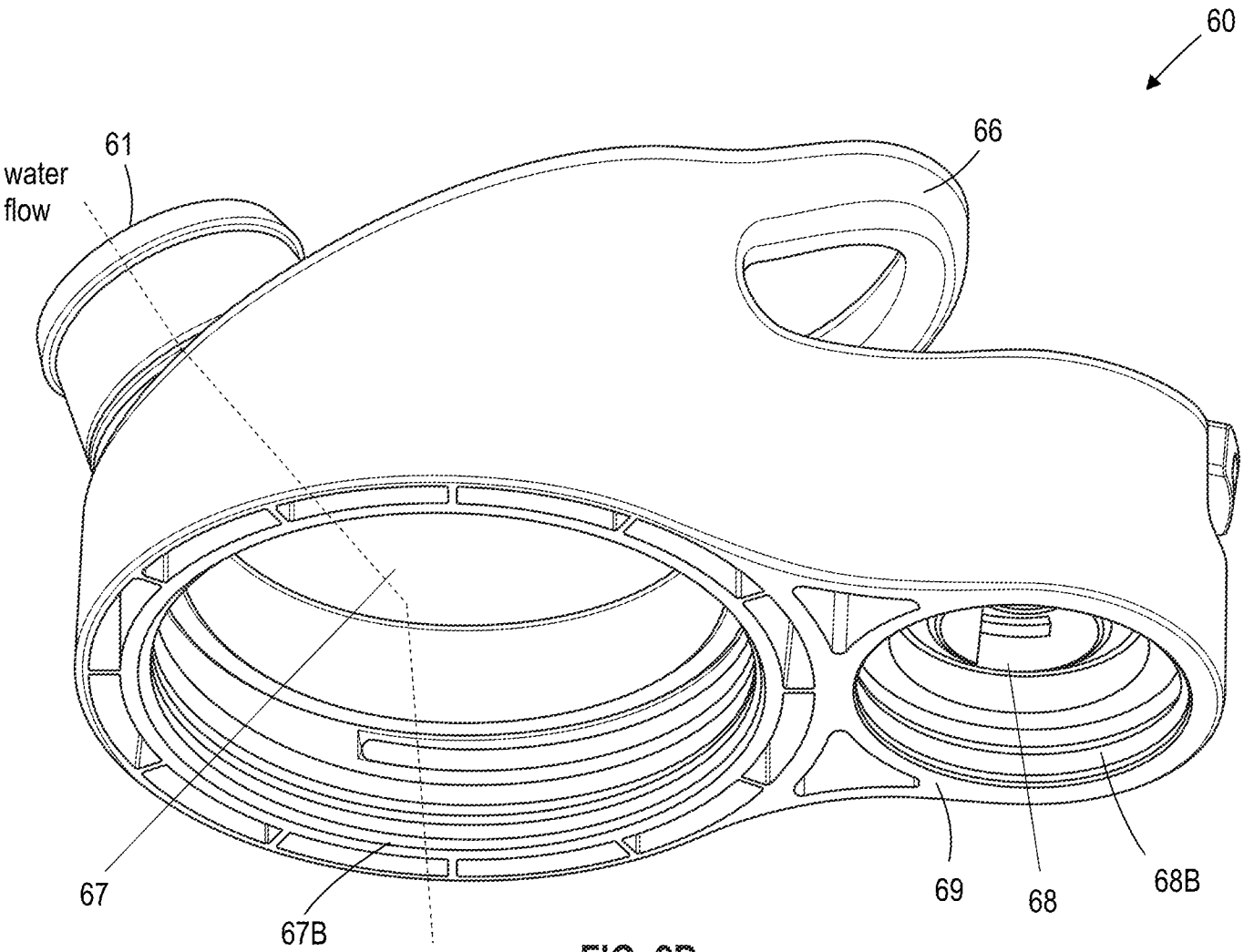
FIG. 2B shows top perspective view of a lid usable in conjunction with the mobile handwashing system, according to the first embodiment of the disclosure.

FIG. 2B shows a bottom perspective view of the lid 60. As can be seen in FIG. 2B, the lid bottom 69 includes a first lid opening 67A having a first lid threading 67B and a second lid opening 68A having a second lid threading 68B.

Figure 3:
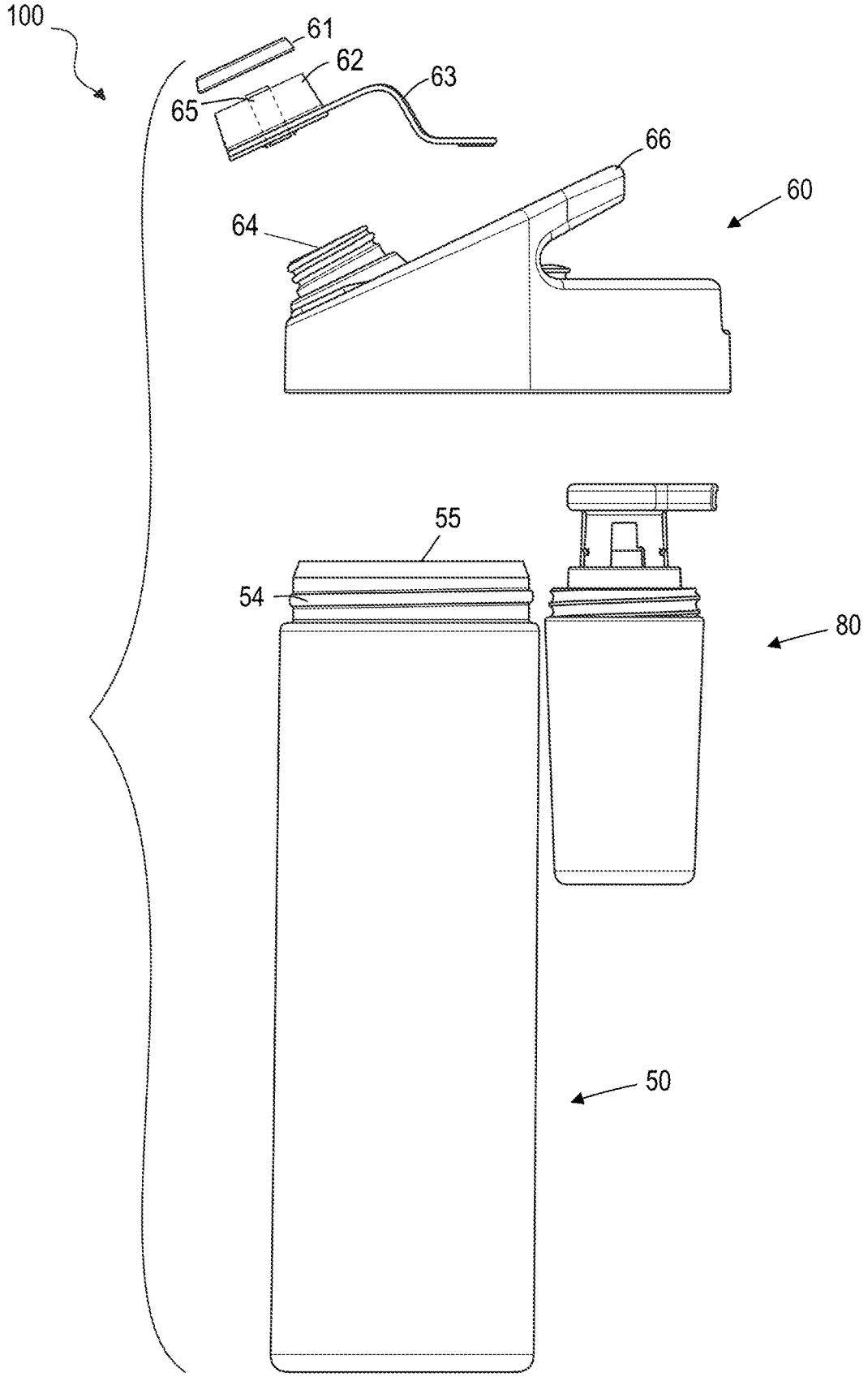
FIG. 3 shows an exploded view of the mobile handwashing system, according to the first embodiment of the disclosure.

FIG. 3 shows an exploded view of the mobile handwashing system 100. The water bottle 50 can be attached to (screwed into) the lid 60 such that the first lid opening 67A aligns with the water bottle top opening 55 inasmuch as the first water bottle threading 54 is complementary with the first lid threading 67A.

Figure 4:
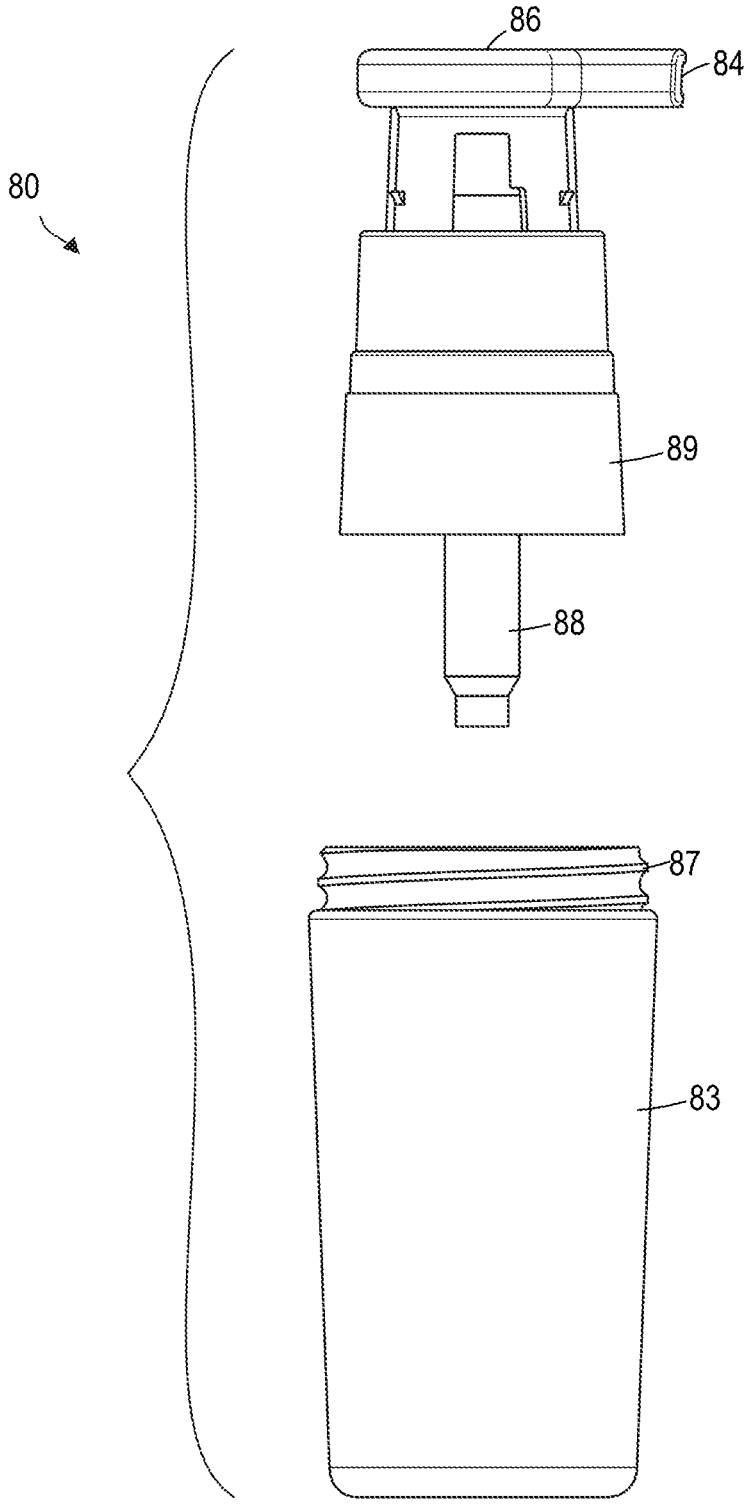
FIG. 4 shows an exploded view of the soap dispenser of the mobile handwashing system, according to the first embodiment of the disclosure.

FIG. 4 shows an exploded view of the soap dispenser 80. The soap dispenser 80 includes a hand pump 89. As is known in the art, when the user presses a pump such as the one illustrated, liquid can be drawn out. In the illustrated embodiment, when the pump head 86 is pressed, a quantity of soap is drawn from the soap reservoir 83 through a soap dispenser dip tube 88 and out an pump top opening 84 in the pump head 86. Preferably, the soap in the reservoir 83 is foaming soap although other types of liquid soap may suffice. It is to be understood that the volume capacity of the water bottle 50 is several times greater than the volume capacity of the reservoir 83. Furthermore, preferably, the reservoir 83 can be removed so that it can be re-filled by unscrewing the reservoir 83. The reservoir threading 87 is complementary with the second lid threading 68B allowing the reservoir 83 to be screwed onto (and off from) the lid 60. The hand pump 89 can be inserted into the reservoir 83 such that a majority of the hand pump 89 will sit within the reservoir 83. In a preferred embodiment, the reservoir 83 can be refilled with soap by the user. In other embodiments, the reservoir 83 is not re-fillable.

Figure 5:
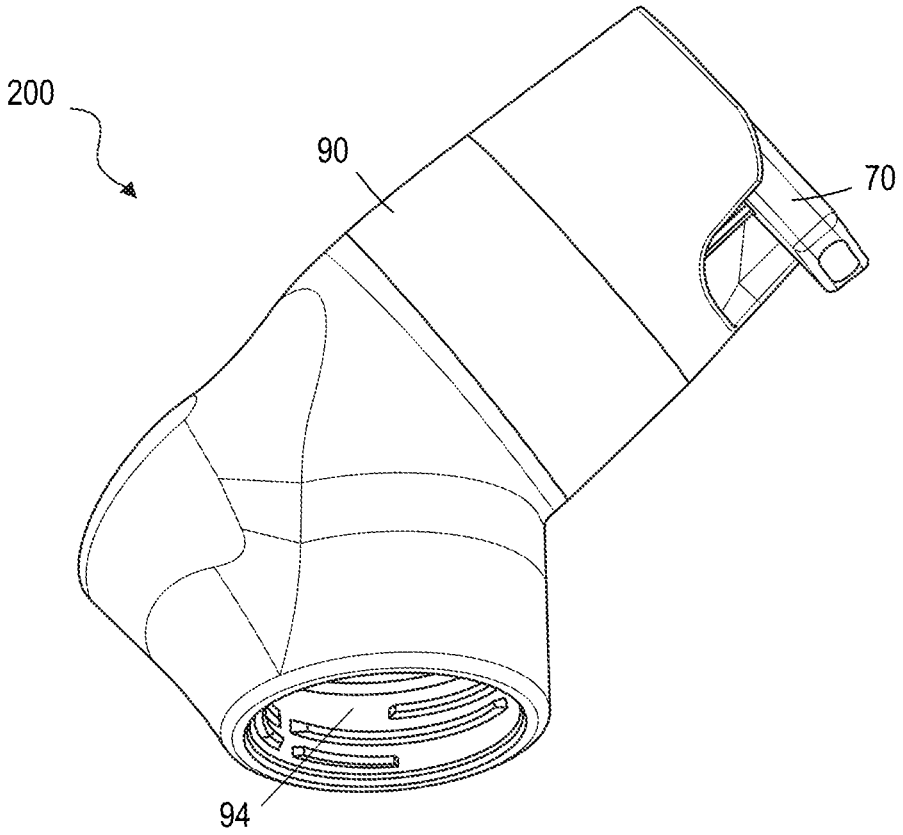
FIG. 5 shows a perspective view of a mobile handwashing system, according to a second embodiment of the disclosure.

Referring to FIG. 5, a perspective view of a mobile handwashing system 200, according to a second embodiment of the disclosure, is illustrated. The mobile handwashing system 200 is conceptually similar to the mobile handwashing system 100, the main difference being that the mobile handwashing system 200 fits a disposable water bottle (generally made from plastic and meant for one-time use). As shown, the mobile handwashing system 200 includes a body 90 that can hold a soap dispenser 70 at an acute angle (e.g., about 45 degrees) relative to a bottle top connector 94 that fits a disposable plastic water bottle. Such a plastic water bottle typically contains about 12-24 ounces of water, and has a top opening with an outer diameter of no more than about 35 mm. Examples of such plastic water bottles include bottled water from Arrowhead, Aquafina, Evian, Dasani, and Poland Springs. It is to be understood that other sizes of bottles may be used so long as the bottle top used fits snugly into the top connector 94. It is further to be understood therefore that the inner diameter of the top connector 94 will be sized accordingly.

Figure 6:
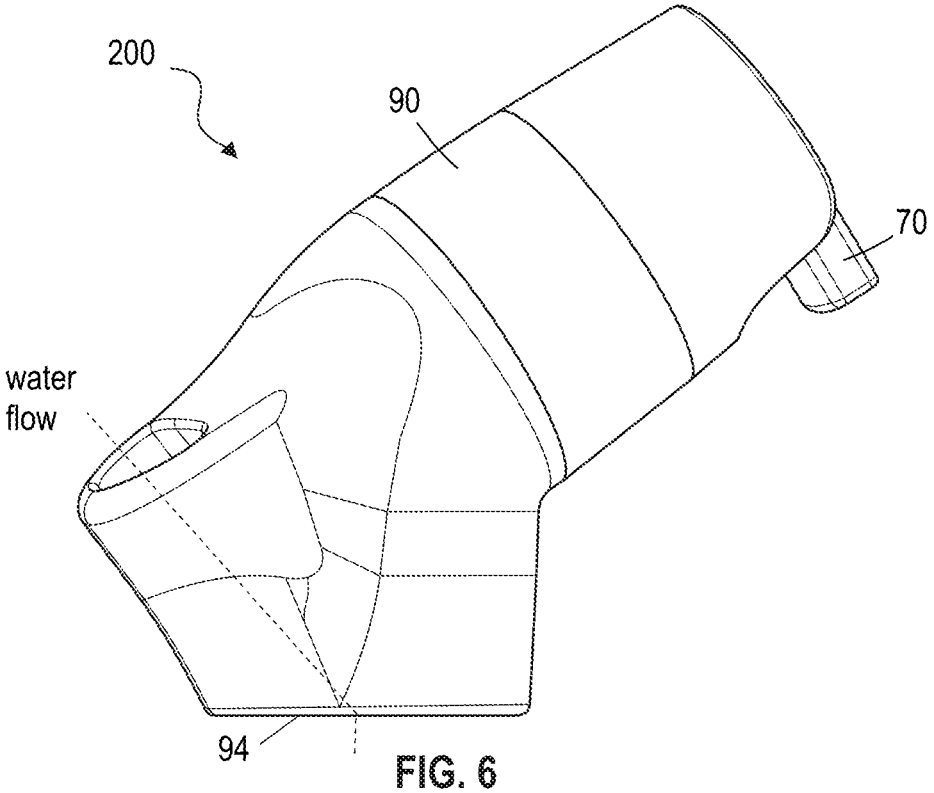
FIG. 6 shows another perspective view of the mobile handwashing system, according to the second embodiment of the disclosure.

FIG. 6 shows another perspective view of the mobile handwashing system 200. In this view, a body opening 92 is shown. The body opening 92 extends to an attached water bottle when the mobile handwashing system 200 is used, and is in liquid communication with the water contained in the water bottle such water can flow from the attached water bottle through the opening.

Figure 7:
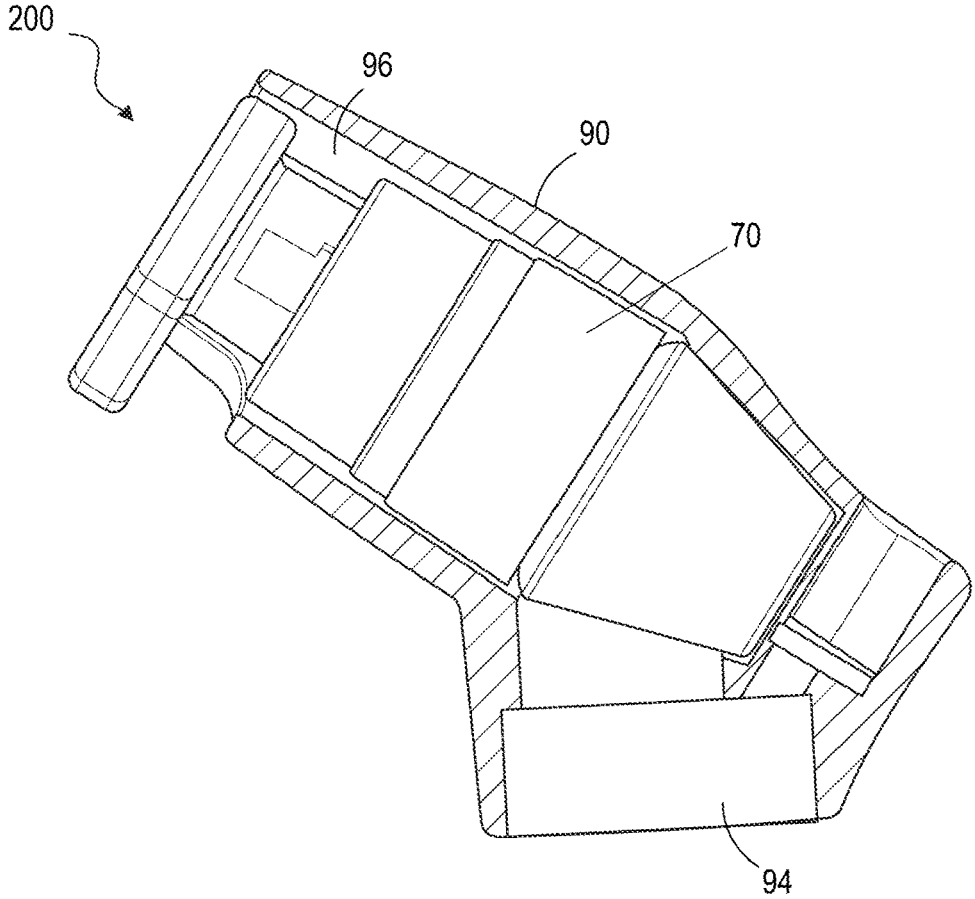
FIG. 7 shows a cutaway view of the mobile handwashing system, according to the second embodiment of the disclosure.

FIG. 7 shows a cutaway view of the mobile handwashing system 200. As can be seen, the body 90 includes a body cavity 96 that is sized to snugly fit the soap dispenser 70. In a preferred embodiment, the soap dispenser 70 can be pulled out from the body cavity 96 so as to be refilled or replaced. In other embodiments, the soap dispenser 70 is not re-fillable.

Figure 8:
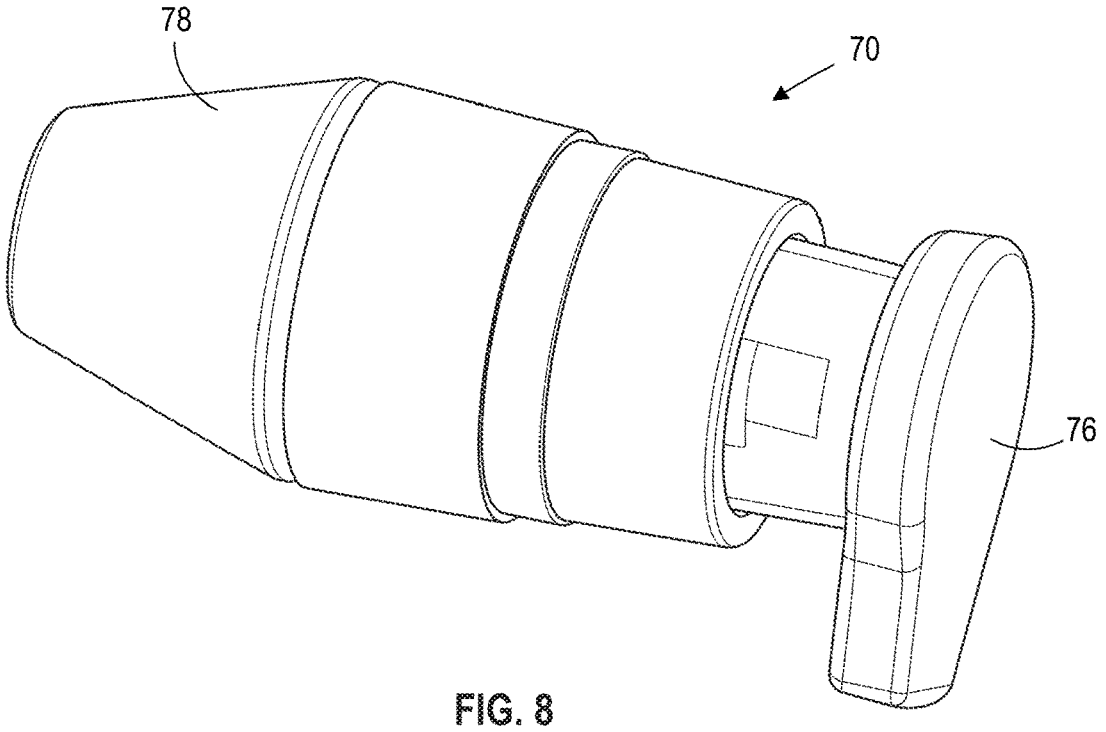
FIG. 8 shows a perspective view of the soap dispenser of the mobile handwashing system, according to the second embodiment of the disclosure.

FIG. 8 shows a perspective view of the soap dispenser 70. The soap dispenser 70 includes a reservoir 78 attached thereto. The reservoir 78 can be filled with liquid soap, preferably a foaming soap although other types of liquid soap or the like may suffice. The soap dispenser 70 can be a hand pump such that he soap can be drawn from the reservoir 78 by pressing pump head 76.

In operation, a method for handwashing includes providing a mobile handwashing system (i.e., the mobile handwashing system 100 or the mobile handwashing system 200), dispensing soap from the soap dispenser onto at least one hand of a person; rubbing hands of the person together; and pouring water from the water bottle through an opening onto hands of the person for rinsing purposes.

Although the features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A mobile handwashing system, comprising:

a removable water bottle lid having a base that can threadably connect to a reservoir of a personal-size water bottle used for drinking;

a soap dispenser connected to said removable water bottle lid at said base but that is separated from and in planar alignment with said base and threadably attachable to a separate reservoir containing soap wherein said reservoir containing water and said reservoir containing soap are at all times separated from each other wherein said separate reservoir containing soap is not located inside of said water reservoir yet each being attachable to said base of said removable water bottle lid.

2. The mobile handwashing system of claim 1, wherein the soap dispenser dispenses soap using a manual pump.

3. The mobile handwashing system of claim 2, wherein the soap is foaming soap.

4. A mobile handwashing system, comprising:

a removable water bottle lid having a base that can threadably connect to a reservoir containing water of a personal-size water bottle used for drinking;

a first funnel extending upward from said base through which water can flow therethrough;

a second funnel extending upward from said base adjacent said first funnel which connects to a soap dispenser;

a manual pump connected to said soap dispenser through which soap can be expelled therethrough wherein said first funnel through which water can flow therethrough and said second funnel through which soap can be dispensed therefrom are at all times separated from each other yet being attachable to a water bottle lid.

5. The mobile handwashing system of claim 4, wherein the soap is foaming soap.

* * * * *